US009212530B2

(12) United States Patent
Streater, Jr. et al.

(10) Patent No.: US 9,212,530 B2
(45) Date of Patent: Dec. 15, 2015

(54) ASSEMBLY AND METHOD FOR WIDE CATCH OVERSHOT

(75) Inventors: James R. Streater, Jr., Humble, TX (US); Daniel Hernandez, Jr., Pasadena, TX (US); Jose Saldana, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 684 days.

(21) Appl. No.: 12/946,595

(22) Filed: Nov. 15, 2010

(65) Prior Publication Data

US 2011/0114317 A1 May 19, 2011

Related U.S. Application Data

(60) Provisional application No. 61/261,556, filed on Nov. 16, 2009.

(51) Int. Cl.
*E21B 31/18* (2006.01)
*E21B 31/12* (2006.01)

(52) U.S. Cl.
CPC ..... *E21B 31/18* (2013.01)

(58) Field of Classification Search
CPC ..... E21B 31/18; E21B 31/12
USPC ..... 166/301, 98; 294/86.1, 86.14, 86.24, 294/86.26, 81.32, 86.17
See application file for complete search history.

(56) References Cited

U.S. PATENT DOCUMENTS 1,687,808 A * 10/1928 Idris et al. ..... 294/86.25
2,174,077 A 9/1939 Bowen
2,491,392 A 12/1949 Osmun
2,492,813 A 12/1949 Osmun
2,616,752 A 11/1952 Osmun
2,659,440 A 11/1953 Osmun
2,743,130 A 4/1956 Osmun
2,753,208 A 7/1956 Bus, Sr.
2,945,720 A 7/1960 Osmun
2,955,868 A 10/1960 Horn, Jr.
2,970,859 A 2/1961 Justice
2,973,037 A * 2/1961 Kennard ..... 294/86.22
3,191,981 A * 6/1965 Osmun ..... 294/86.31
3,727,967 A 4/1973 Anastasiu et al.

(Continued)

OTHER PUBLICATIONS

"Series 150 Overshots: Series 150 Releasing and Circulating Overshots", Instruction Manual 1150 R3, National Oilwell, Aug. 2003, 25 pgs.

(Continued)

*Primary Examiner* — Blake Michener
*Assistant Examiner* — Kipp Wallace
(74) *Attorney, Agent, or Firm* — Winston & Strawn LLP

(57) ABSTRACT

A grapple for use in an overshot has a tension ring with a reduced helix diameter. However, the helix diameter is not reduced on either sides of the control finger slot to allow the grapple to remain in contact with the control. In the alternative, a composite helix member may be utilized. Another embodiment comprises the inclusion of expansion blades on the inner diameter ("ID") of the tension ring which allow the grapple to expand substantially before the fish reaches the segments. Another embodiment provides for a control with an offset finger to allow the guide thread ID to be smaller than the bowl helix major ID. Yet another embodiment provides a spiral grapple having grooves along its axis to provide the ability to catch a larger range of fish.

29 Claims, 15 Drawing Sheets

(56) References Cited

U.S. PATENT DOCUMENTS

| | | | | |
|---|---|---|---|---|
| 3,746,093 | A * | 7/1973 | Mullins | 166/217 |
| 4,023,847 | A * | 5/1977 | Webb | 294/86.3 |
| 4,157,199 | A | 6/1979 | Klingman | |
| 5,054,832 | A | 10/1991 | Davis et al. | |
| 5,765,638 | A | 6/1998 | Taylor | |
| 6,425,615 | B1 | 7/2002 | Mullane, Jr. | |
| 2008/0066914 | A1 | 3/2008 | Fay | |
| 2011/0114317 | A1 | 5/2011 | Streater, Jr. et al. | |

OTHER PUBLICATIONS

International Search Report and Written Opinion dated Jan. 14, 2011, for PCT/US2010/056848, filed Nov. 16, 2010.

International Search Report and Written Opinion, PCT/US2013/069014, mailed Mar. 27, 2015.

* cited by examiner

ASSEMBLY AND METHOD FOR WIDE CATCH OVERSHOT

PRIORITY

This application claims the benefit of U.S. Provisional Application No. 61/261,556, filed on Nov. 16, 2009, entitled "ASSEMBLY AND METHOD FOR WIDE CATCH OVERSHOT," naming James R. Streater, Jr., Daniel Hernandez, Jr., and Jose A. Saldana, Jr. as inventors, which is hereby incorporated by reference in its entirety.

FIELD OF THE INVENTION

The present invention relates generally to overshots utilized in fishing operations and, more particularly, to modifications to grapples, controls and bowls to enable engagement of a larger range of fish.

BACKGROUND OF THE INVENTION

Currently, overshots are used to externally catch stuck fish during oil field operations. Existing overshots are designed to catch a range of fish of approximately ⅛", varying between tools of different sizes. During fishing operations, it is very common that the object the operator is trying to engage has not maintained its original outer diameter ("OD") due to wear. This unknown wear often prevents the overshot from engaging the fish on the first attempt and, therefore, can result in sometimes 2 or 3 trips downhole with smaller sized grapples to catch the fish. As a result, the cost and time of the fishing operation can be significantly increased.

In addition, problems can arise when the grapple engages larger fish. In such instances, the tension rings of the grapples can experience very large stresses at the ring concentration points which may result in the yielding of the grapple. Prior art tools that directly address the yielding of the ring due to engaging a larger range of fish are not immediately available. However, prior art tools have utilized a completely reduced OD on the grapple ring in order to reduce the stress. This feature of the prior art, however, is disadvantageous because completely reducing the ring limits the ability of the grapple to stay in contact with the control finger or other devices used to transfer torque.

Moreover, as the catch range of prior art overshots is increased, the corresponding required internal bowl dimensions require the wall thickness of the bowl to be decreased in order to allow the grapple to expand fully. Accordingly, this limits the maximum catch range of prior art overshots because the bowl wall can only be decreased so much before possible failure.

Accordingly, there is a need in the art for an overshot adapted to efficiently catch a larger range of fish, while reducing the associated stresses and retaining the integrity of the overshot.

SUMMARY OF THE INVENTION

The present invention provides methods and assemblies for modifying an overshot to enable it to catch a larger range of fish. In a first exemplary embodiment, the present invention allows the stresses in the tension ring of a basket grapple to be reduced, prevents the grapple segments from fracturing, and reduces the force necessary to expand the grapple. This is achieved, in part, by reducing down the diameter of the helix on the tension ring, thereby allowing the grapple to experience less stress as it expands. However, the helix diameter on either side of the control finger slot is not reduced in order to allow the grapple to remain in contact with the control finger despite the much increased diametrical clearance between the grapple and bowl of the increased catch range overshot of the present invention. In the alternative, the entire helix diameter may be reduced and a composite helix member may be placed along both sides of the control finger slot in order to allow the grapple to remain in contact with the control finger slot during use. Accordingly, through the use of the reduced helix diameter along the tension ring, the present invention greatly reduce the stress that the ring will experience, while still allowing torque transfer so that the grapple will engage the fish in one run.

In a second exemplary embodiment, the present invention comprises expansion blades on the inner diameter ("ID") of the tension ring which allow the grapple to expand substantially before the fish reaches the grapple segments behind the flex holes. Therefore, the cantilever effect and corresponding high stresses experienced in prior art basket grapples with smooth counterbored IDs are greatly reduced. In this embodiment, the force required to expand the grapple is applied to the blades to expand the tension ring with direct force. When the fish passes beyond the flex holes behind the segments, the grapple is much closer to the ID of the bowl, which greatly reduces the amount of cantilever deflection in the segment created before the bowl can support the grapple. In addition, the stresses in the tension ring are also reduced through grooves created as the blades are formed.

In a third exemplary embodiment, the present invention provides methods and assemblies providing a control with an offset finger for a wide catch overshot. The offset finger allows the overshot to have guide threads on the lower end of the bowl that are smaller in diameter than would otherwise be possible with prior art controls in which the finger is flush with the OD of the control. In this embodiment, the bowl threads have a single groove machined through the entire length of the threads to allow passage of the offset finger on the control during assembly. The offset finger allows the control to have a complete or partial ring and be inserted into a bowl with an ID where the use of a prior art control would not be possible. A complete or partial ring for the control of the present invention allows it to remain in position with the bowl during operations and is less likely to lose contact with the grapple. In addition, the control finger may be comprised of one solid piece or composite pieces.

In a fourth exemplary embodiment, the present invention provides methods and assemblies for a spiral grapple for use in a wide catch overshot. The grapple comprises one or more grooves along its axis which reduce stress as the grapple expands. The grooves may be cut in a direction along the axis of the grapple or may be cut at angles. The wickers may comprise chamfered edges to combat biting as the grapple is rotated along the fish. In addition, the control utilized with the spiral grapple also comprises an offset finger.

DESCRIPTION OF ILLUSTRATIVE EMBODIMENTS

Illustrative embodiments of the invention are described below as they might be employed to provide a more efficient and cost-effective fishing operation. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Figure 1:
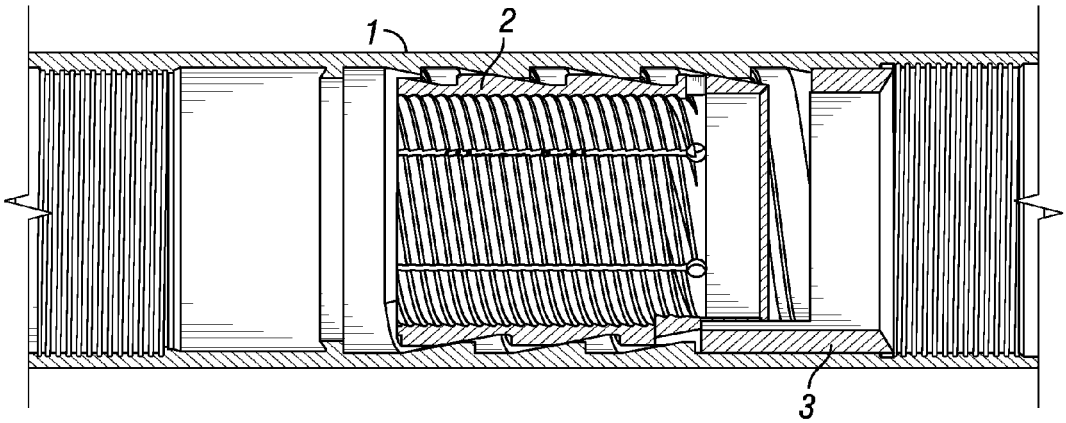
FIG. 1 (Prior Art)
FIG. 1 illustrates an overshot according to the prior art.
Figure 2:
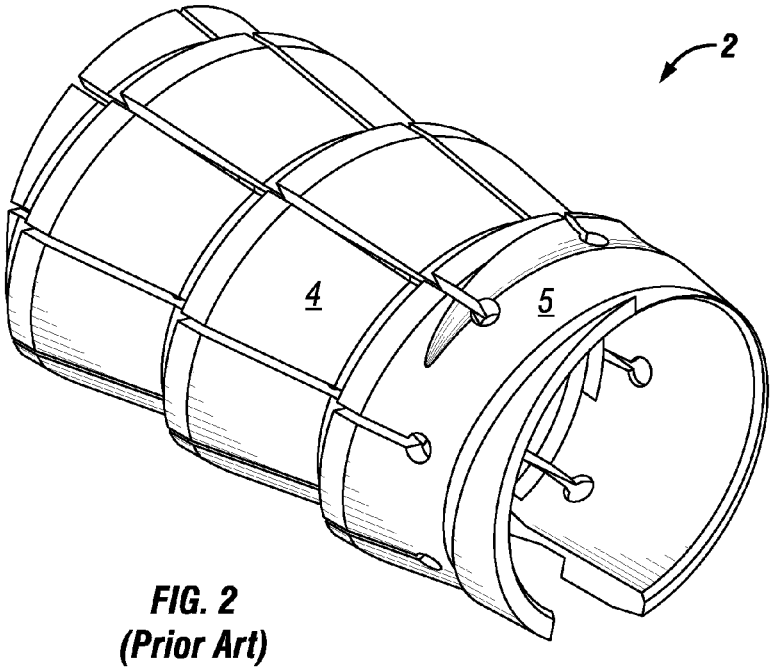
FIG. 2 (Prior Art)
FIG. 2 illustrates a basket grapple according to the prior art.

FIGS. 1 and 2 illustrate a prior art overshot and basket grapple, respectively. The basic design of an overshot consists of a bowl 1, a grapple 2, a control 3, and guide (not shown). The grapple operates such that as the fish enters the grapple from the bottom, the grapple expands until the fish has passed the inner wickers of the grapple. Referring to the grapple of FIG. 2, as the outside bowl is lifted up, the helix on the outside of the segments 4 of the grapple 2 comes into contact with the helix on the inside of the bowl. When an upward pull is exerted in the overshot, the grapple contracts around the fish. Due to wickers that are machined on the ID of the grapple, the grapple effectively engages the fish. Each grapple has a maximum and minimum catch size that it can attain. In the prior art, for example, that range can be 1/32" over and 3/32" under the nominal size. The effective total range is therefore 1/8". For embodiments of the present invention, however, the total range could be 1/4", 5/16", 3/8", 1/2", or greater depending on the tool size. Those ordinarily skilled in the art having the benefit of this disclosure realize the features of the present invention described herein may be modified to fit a variety of tools.

Because the grapple of the present invention must cover a variety of ranges, it must be sized for the minimum size, but still be able to expand to catch the maximum size. This requires that the tension ring 5 be capable of expanding for the full range of the grapple 2. This expansion can cause the tension ring 5 to deform due to stress concentration points. In order to correct this problem, an exemplary embodiment of the present invention is provided in FIGS. 3A & 3B. Here, the helix diameter 11 of tension ring 5 is turned down, i.e., reduced, to the minimum helix diameter, except for the portions of the helix diameter adjacent both sides of the control finger slot 9. As understood in the art, the "helix diameter" is the diameter of the helix on the OD of the grapple. As also understood in the art, the minimum helix diameter is the smallest possible helix diameter the grapple can have.

Figure 3A:
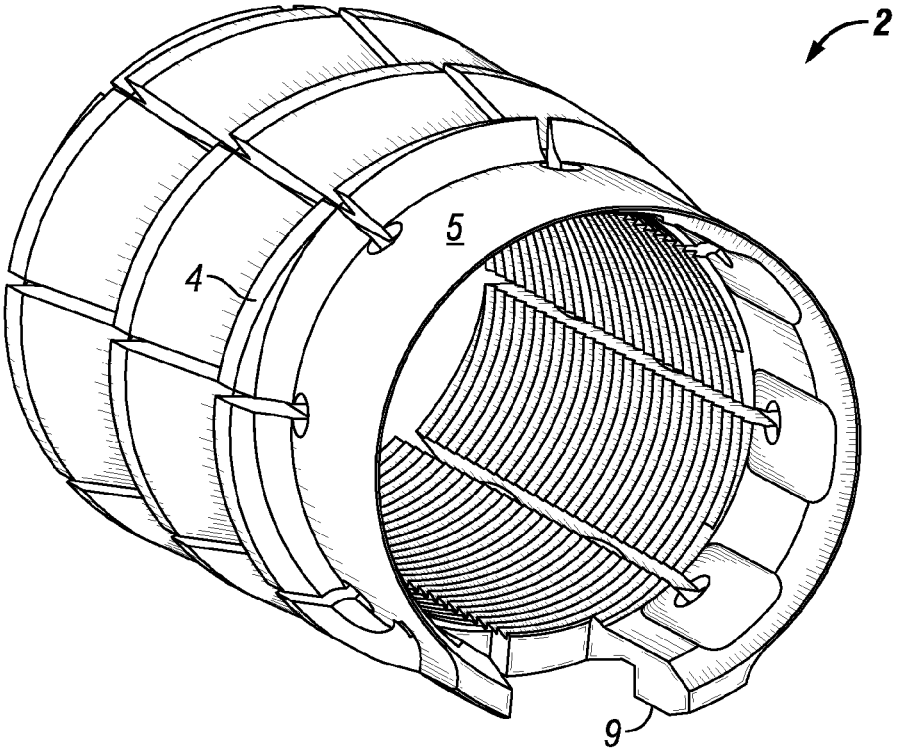
FIGS. 3A & 3B illustrate a perspective and bottom side view, respectively, of a grapple having a reduced helix diameter according to an exemplary embodiment of the present invention.
Figure 3B:
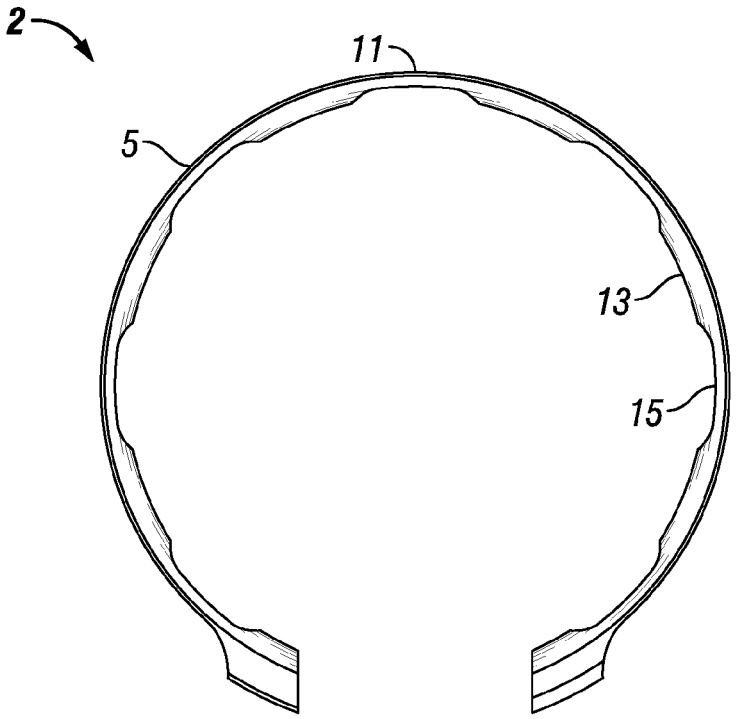

Further referring to FIGS. 3A and 3B, portions of helix diameter 11 adjacent control finger slot 9 are larger in relation to the remaining portions of helix diameter 11. In this exemplary embodiment, the largest OD of the helix diameter 11 is the major OD, while the smallest OD of helix diameter 11 is the minor or minimum OD. However, this may vary by tool. Removal of a portion of helix diameter 11 along tension ring 5 reduces the amount of force, and associated stresses, required to open grapple 2. Although portions of helix diameter 11 are illustrated as completely reduced in FIGS. 3A & 3B, those ordinarily skilled in the art having the benefit of this disclosure realize portions of helix diameter 11 could instead be partially reduced. Moreover, removal of the helix diameter may be accomplished via any method known in the art such as, for example, milling or machining.

Figure 4:
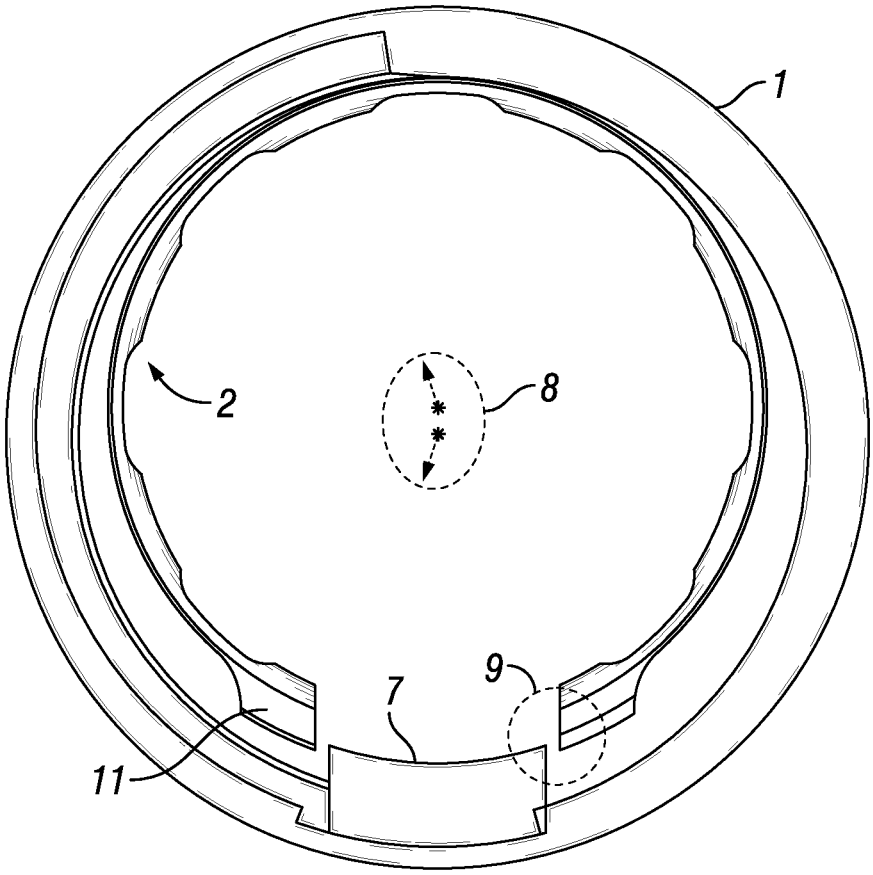
FIG. 4 illustrates an overshot according to an exemplary embodiment of the present invention.

Referring to the exemplary embodiments of FIGS. 3A, 3B and 4, utilizing the present invention results in the diametrical clearance between the bowl 1 and grapple 2 being significantly increased, as illustrated in FIG. 4. As a result, the grapple must expand more in the bowl and thus is more capable of losing contact with the control finger 7. This is very apparent when the grapple 2 is pushed to the opposite side of the bowl 1 or if the axis of symmetry for the bowl 1 and grapple 2 are displaced 8, as illustrated in FIG. 4. In order to correct this, the helix diameter 11 must remain on both sides of control finger slot 9. By allowing the helix diameter 11 to remain at finger slot 9, it is possible to get the flexibility of the thinner ring but still stay in contact with the control finger at all times. This feature is an advancement over the prior art because the catch range of a prior art grapple is limited since the grapple must remain in contact with the control finger.

Figure 5:
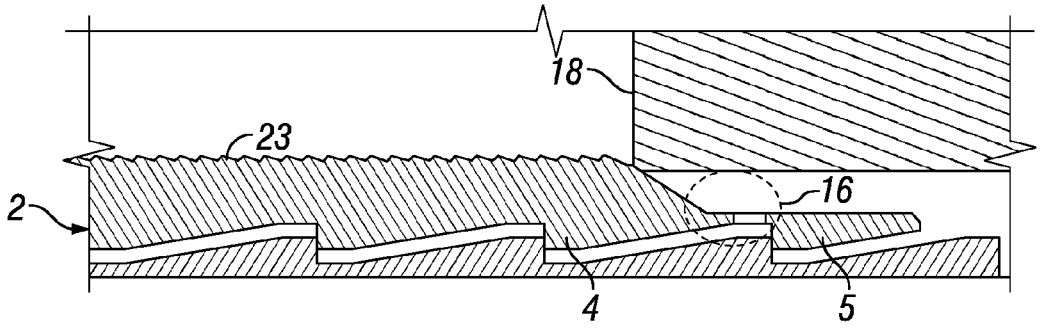
FIG. 5 (Prior Art)
FIGS. 5 and 6 illustrate views of a basket grapple stress points according to the prior art.
Figure 6:
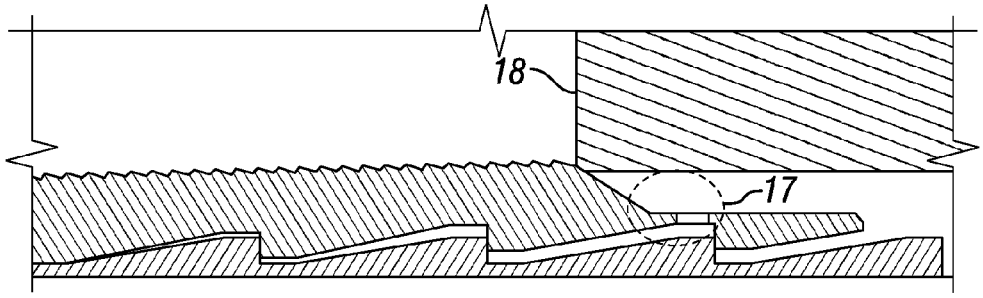
FIG. 6 (Prior Art)

FIGS. 5 and 6 illustrate the bending forces associated with the prior art grapples. As the fish 18 enters the grapple 2 and comes into contact with the wickers 23, a large bending moment 16 is placed on the grapple segments 4. When this occurs, the tension ring 5 must expand the full range. Because a majority of the force used to expand the fish is placed on the segments 4, they are very susceptible to yielding and cracking at the points 17 in FIG. 6. Therefore, by utilizing the helix diameter 11 of the present invention, such stress points can be alleviated, and one receives the flexibility of the thinner ring while retaining contact with the control finger at all times.

FIGS. 3A & 3B further illustrate an exemplary embodiment of the present invention whereby expansion blades 13 are utilized to allow the ability to catch larger size fish. Stress relieving grooves 15 are placed between expansion blades 13 in order to further relive stress during expansion. Grooves 15 are created by removing material from blades 13 by any method known in the art. In order to reduce the amount of force being applied to the segments 4, multiple expansion blades 13 are added to the ID of the tension ring 5. Those ordinarily skilled in the art having the benefit of this disclosure realize the thickness of blades 13 and the depth of grooves 15 can be varied as desired.

Figure 7:
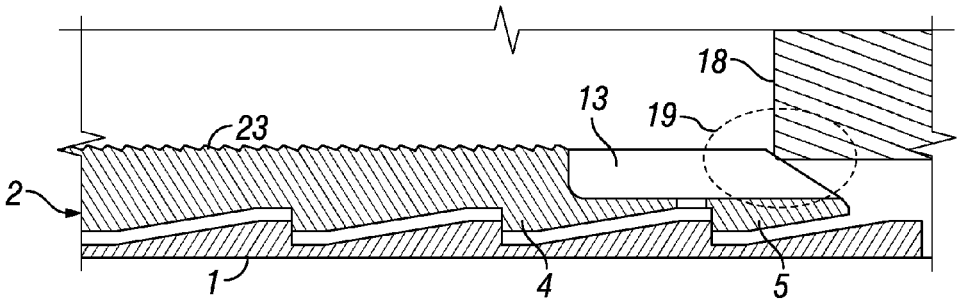
FIGS. 7-9 illustrate embodiments of the present invention whereby stress points are reduced.
Figure 8:
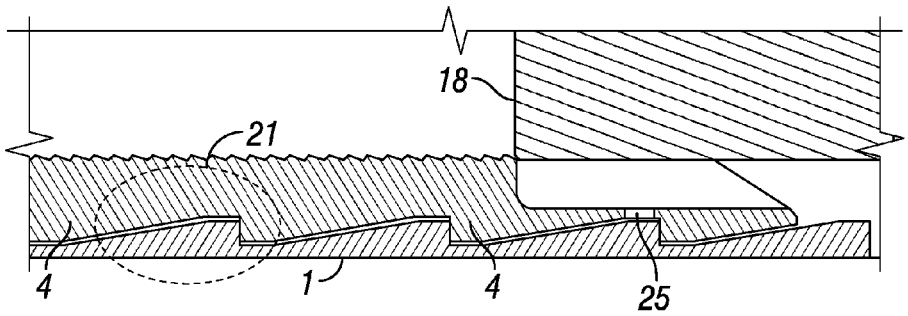
Figure 9:
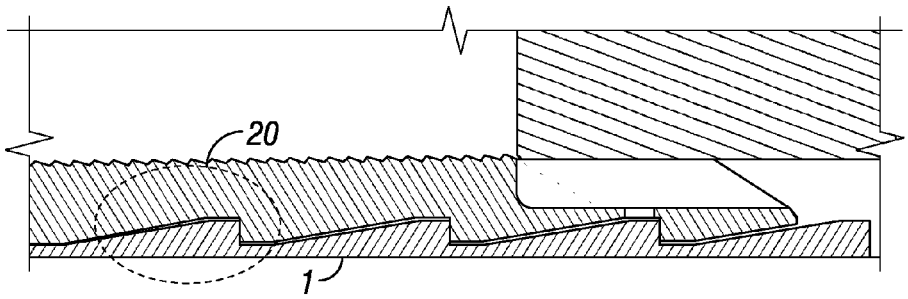

FIGS. 7-9 illustrate the grapple of the present invention and its effectiveness in reducing the stresses exhibited by the prior art design. As the fish 18 enters the grapple 2 and comes into contact with the blades 13, the grapple 2 partially expands 19. This initial expansion 19 would cause the grapple segments 4 to expand and decrease the amount of space between the grapple and the ID of the bowl 1. As the fish continues into the grapple 2, the segments 4 have to expand less due to the majority of the expansion occurring in the blade area (60-80% for example), while the segments 4 gain support from the bowl wall (as illustrated by "20" in FIG. 9). Because there is less space for the segments 4 to flare out (as illustrated by "21" in FIG. 8), they are less susceptible to bending and fracturing. Accordingly, the entire grapple of the present invention expands much more than the prior art tool (in which all expansion occurs with the fish in contact with the segments). In the present invention, however, 60%-80% of the expansion occurs before the fish contacts the segments.

Further referring to FIGS. 7-9, expansion blades 13 allow grapple 2 to expand substantially before the fish 18 reaches grapple segments 4 behind the flex holes 25. Thus, the cantilever effect and corresponding high stresses experienced in prior art basket grapples are greatly reduced. In addition, the force required to expand the grapple 4 is applied to blades 13 to expand the tension ring 5 with direct force. When the fish 18 passes beyond the flex holes 25, as illustrated in FIGS. 8-9, grapple 2 is much closer to the ID of the bowl 1 than the prior art grapple (FIGS. 5-6), thereby greatly reducing the amount of cantilever deflection in the segment 4 created before the bowl 1 can support the grapple 2.

Figure 10A:
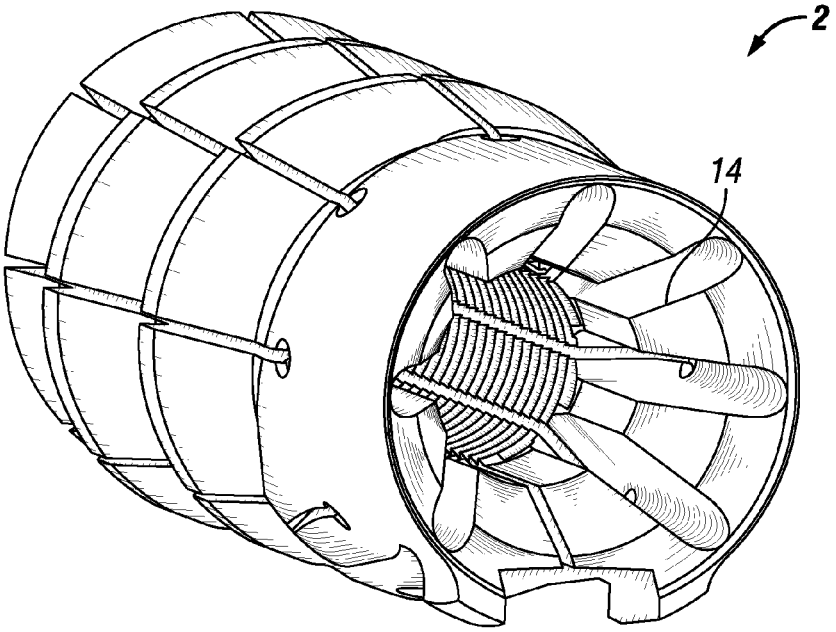
FIGS. 10A & 10B illustrate a perspective and bottom side view, respectively, of a grapple having large expansion blades according to an exemplary embodiment of the present invention.
Figure 10B:
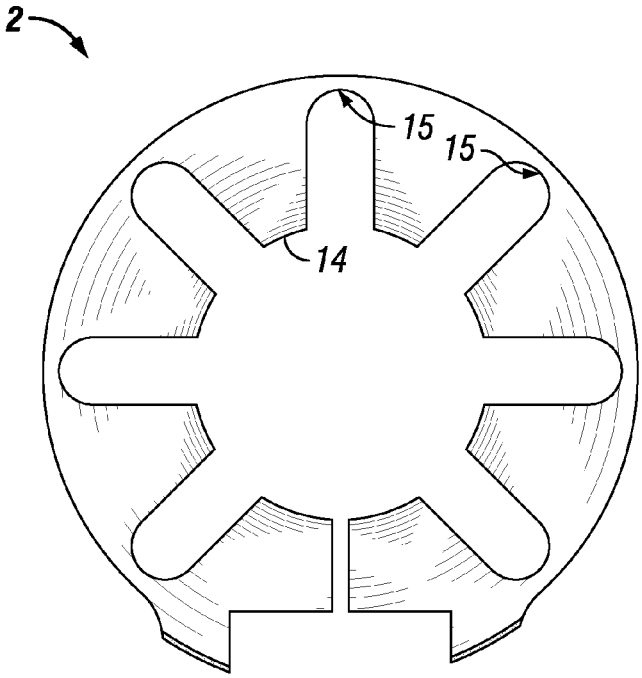
Figure 20:
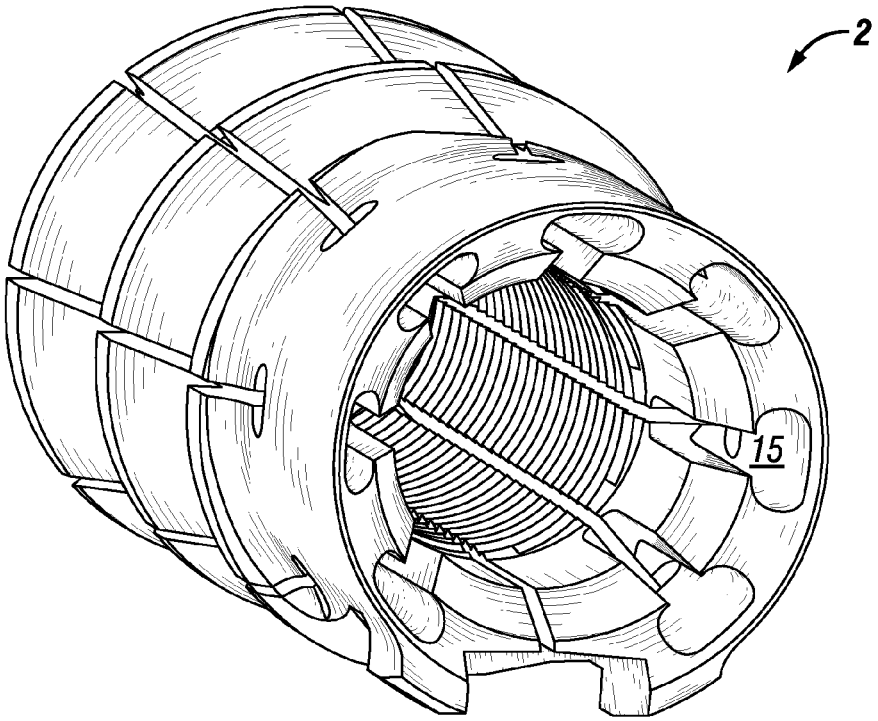
FIG. 20 illustrates an alternate exemplary embodiment of stress relieving grooves according to the present invention.
Figure 21:
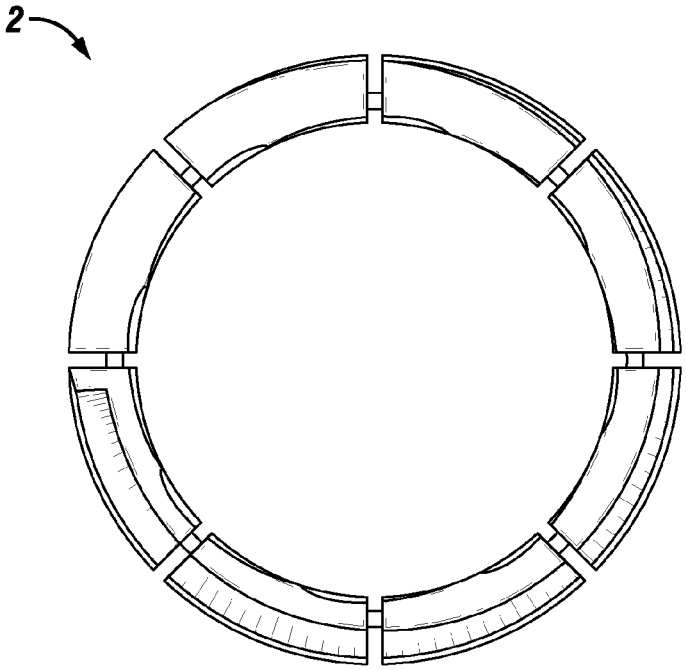
FIG. 21 illustrates a modified version of the saw cuts between the blades according to exemplary embodiments of the present invention.

FIGS. 10A & 10B display an alternative exemplary embodiment having larger expansion blades 14 with much deeper stress relieving grooves 15 due to a smaller nominal catch size. Those ordinarily skilled in the art having the benefit of this disclosure realize the depth of grooves 15, as well as the number of blades 13,14, may be varied as required by design constraints. FIG. 20 illustrates an exemplary alternate embodiment of stress relieving grooves 15. FIG. 21 illustrates a modified version of the blades having eight saw cuts, each at a 45° angle. Those ordinarily skilled in the art having the benefit of this disclosure realize more or less saw cuts may be utilized having varying degrees dependent upon design constraints.

Figure 11:
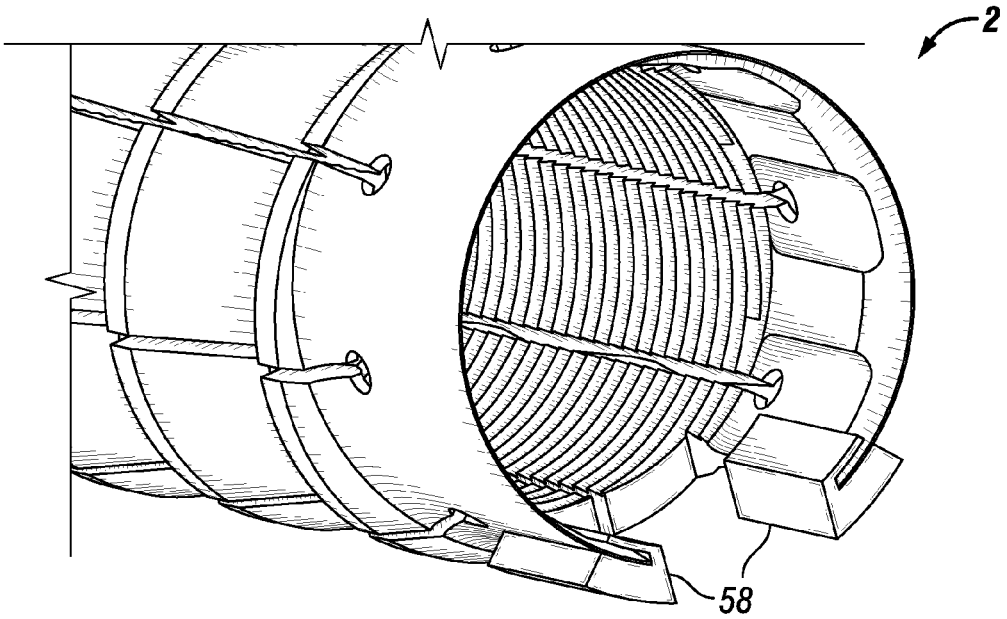
FIGS. 11-12 illustrate views of a composite helix member according to an exemplary embodiment of the present invention.
Figure 12:
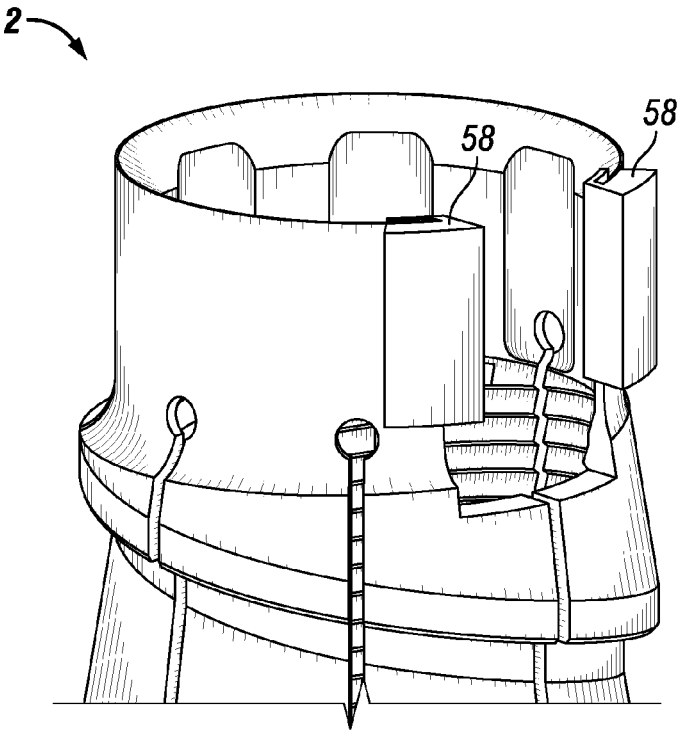

In addition to the milling that can be done to the grapple OD to reduce stress and keep it in contact with the control at all times, a composite helix member 58, such as an optional retainer cap, can be inserted on a completely turned down OD that can serve the same purpose, as illustrated in the exemplary embodiment of FIGS. 11-12. This design allows the OD of the tension ring to be completely turned down, thus minimizing the cost of an extra milling procedure. In order to keep the grapple in contact with the control, composite helix member 58 is placed on the grapple which will effectively act as the helix on both sides of the control slot as described in previous embodiments.

Figure 13:
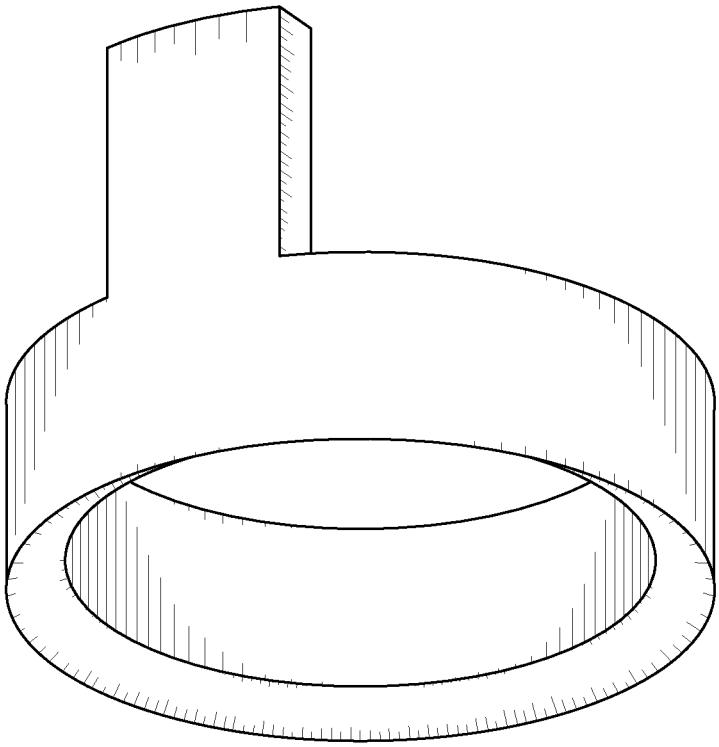
FIG. 13 (Prior Art)
FIG. 13 illustrates a control finger according to the prior art.

Exemplary embodiments of the present invention utilizing an offset control finger will now be described. Referring back to the prior art overshot illustrated in FIG. 1, the basic design consists of a bowl 1, grapple 2, control 3, and guide (not shown). Prior art control fingers (example illustrated in FIG. 13) are available for either basket grapples or spiral grapples, and are called spiral grapple controls and basket grapple controls. Cutting teeth can also be incorporated into the basket control so that it can be used to dress the top of the fish to ease the engaging process. These controls are known as basket mill controls. For the prior art, the grapples can catch a minimum and maximum range. In most cases that range would be 1/32" over and 3/32" under the nominal size which would give an effective total range of approximately 1/8".

However, by designing a wide catch overshot as described in the present invention, the total catch range is significantly increased as previously described. In order to increase the catch range, the grapple must be sized for the minimum size OD, while still able to expand to catch the maximum size OD. This also requires that the bowl be modified accordingly for the grapple. As a result, the bowl ID of the present invention is significantly increased, thereby greatly decreasing the amount of material that is available to machine threads. In order to have a full control for a standard overshot, the control OD is less than the ID of the threads to allow it to be passed through, so the finger can be inserted into the slot on the bowl.

Figure 14:
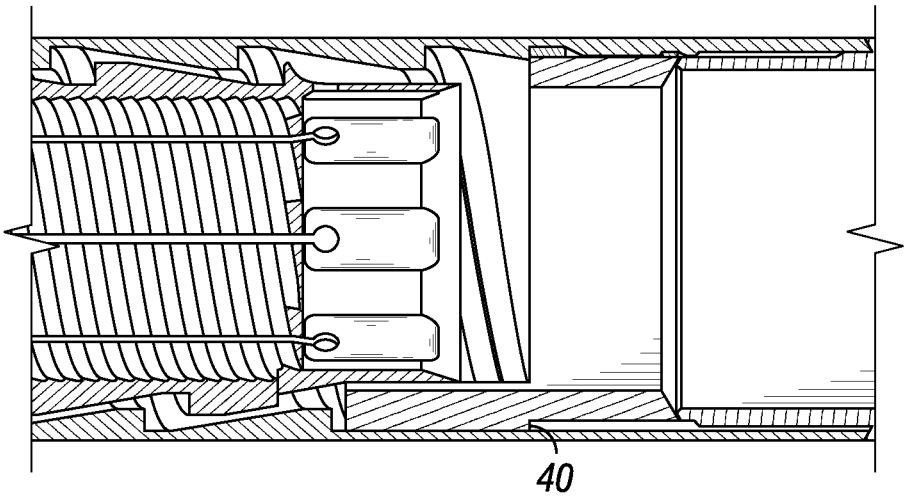
FIGS. 14-15 illustrate exemplary embodiments of an offset control finger according to the present invention.
Figure 15:
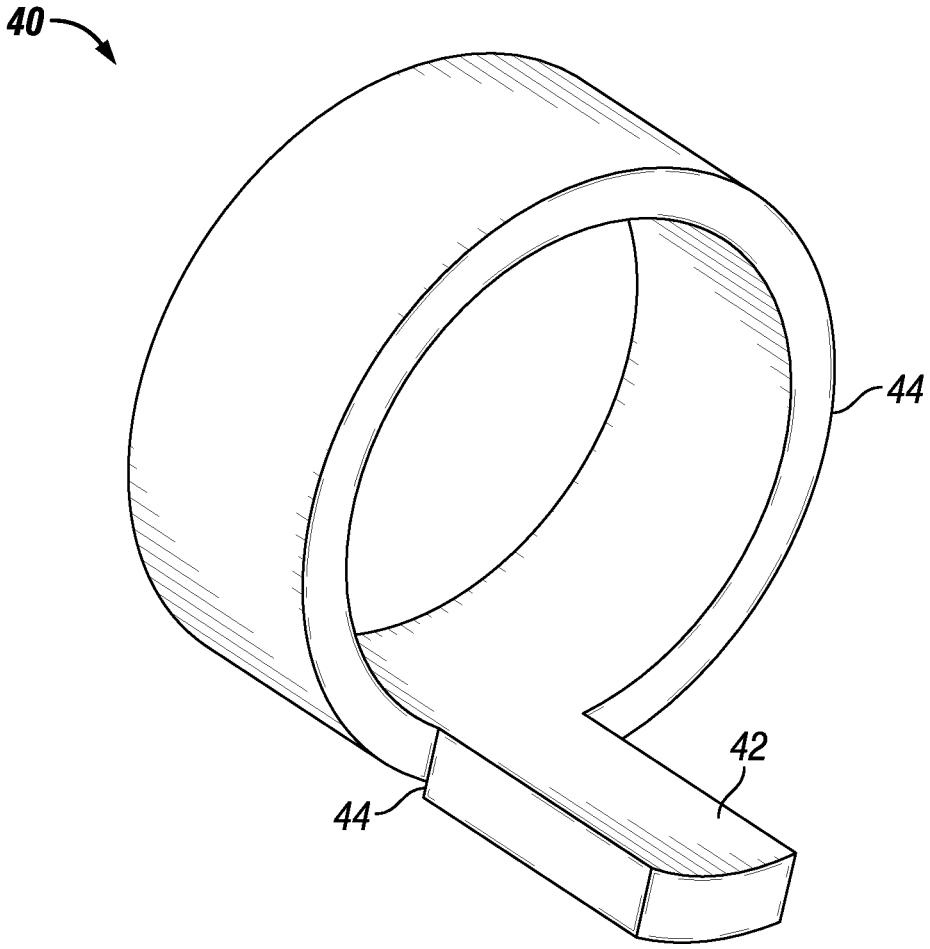
Figure 16:
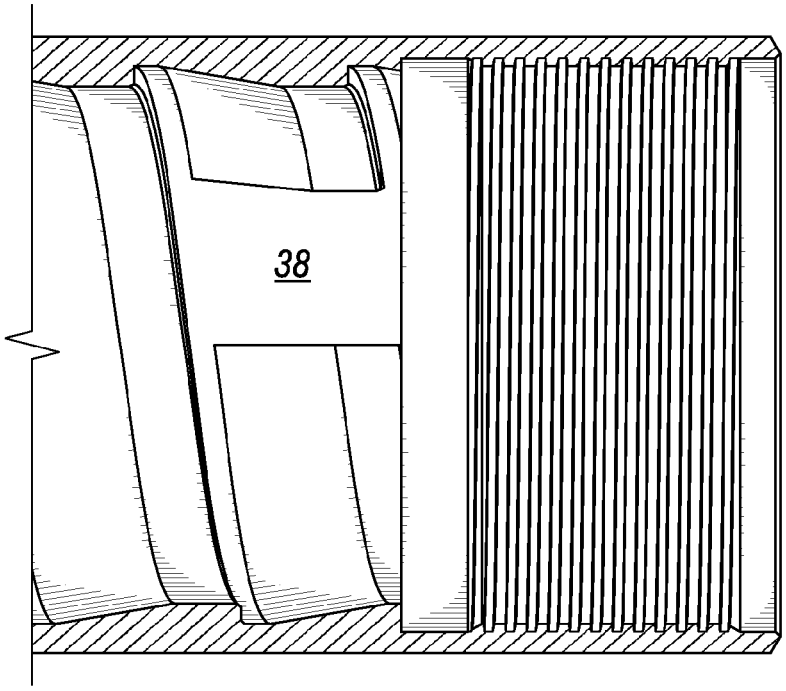
FIG. 16 (Prior Art)
FIG. 16 illustrates a bowl having a slot machine through the helix according to the prior art.
Figure 17:
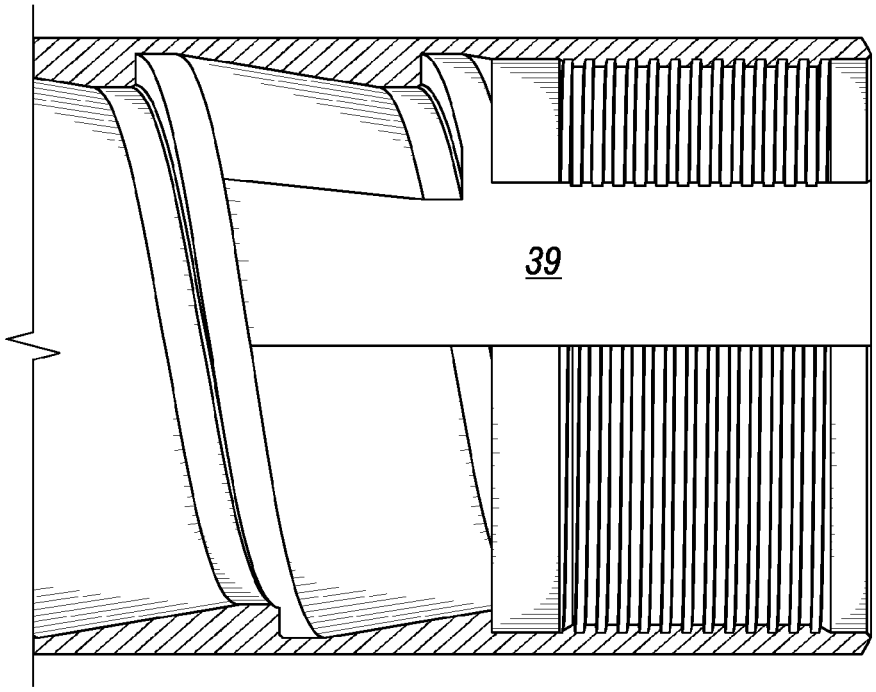
FIG. 17 illustrates an exemplary embodiment of the present invention whereby a slot has been machined through the helix and threads of a bowl.

Accordingly, referring to the exemplary embodiment of FIGS. 15, 18, 19A, and 19B, a newly designed control 40 is provided in the present invention. As shown, control 40 comprises a ring member 44 and a finger 42 extending from ring member 44. For the new design, the outer surface of finger 42 is offset (46) from the outer surface of ring member 44 in order to fit in the bowl and have a smaller OD to get past the threads on the bottom of the bowl. To get offset finger 42 past the threads, the slot that is normally machined though the helix only on prior art bowl 38 (FIG. 16), is now machined through the entire length of bowl threads 39 of the present invention (FIG. 17) in order to allow passage of the offset finger 42 during assembly. By having the slot machined through the bowl threads 39, making the OD of the control smaller, and incorporating offset finger 44, control 40 will remain in contact with the bowl and grapple at all times as illustrated in FIG. 14. As such, the offset finger 42 allows the overshot to have guide threads on the lower end of the bowl which are smaller in diameter than would otherwise be possible with prior art controls in which the finger is flush with the OD of the control.

Figure 18:
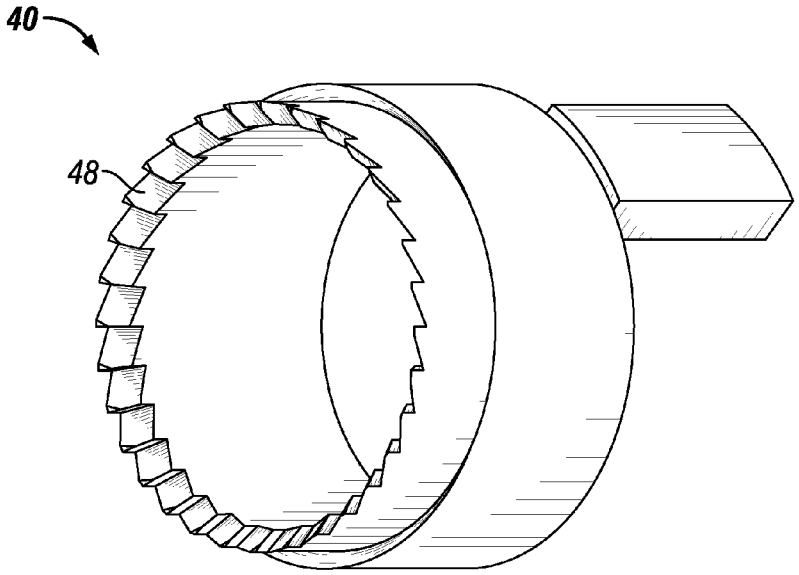
FIGS. 18, 19A & 19B illustrate alternate exemplary embodiments of an offset control finger according to the present invention.
Figure 19A:
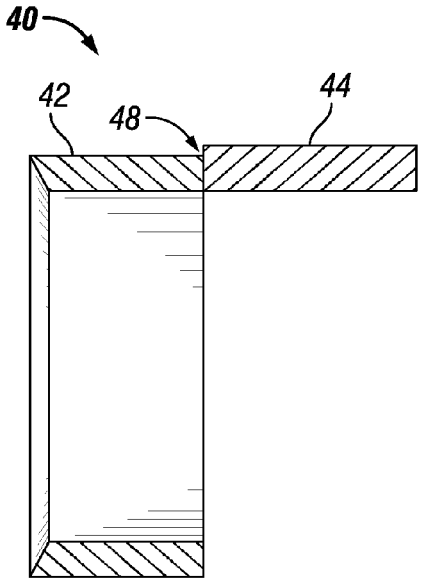
Figure 19B:
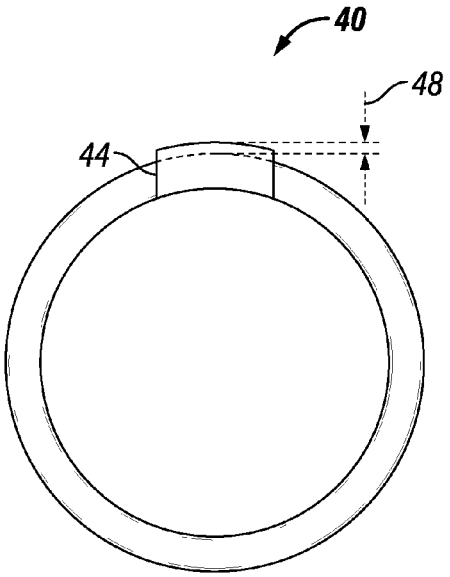

Those ordinarily skilled in the art having the benefit of this disclosure realize the described offset finger is applicable to all types of controls. FIG. 18 illustrates an exemplary control 40 having a series of cutting teeth 48. A sectional view of an offset finger according to an exemplary embodiment of present invention is also provided in FIGS. 19A & 19B. In addition, those ordinarily skilled in the art having the benefit of this disclosure realize that, although described herein in relation to a complete ring configuration, the control 40 may also comprise a partial ring member. Furthermore, the control finger may be comprised of one solid piece or composite pieces.

In yet another alternative embodiment, control 40 may have a plurality of offset fingers. For example, one offset finger may be located at a position 180 degrees from another along ring member 44. As would be understood by one ordinarily skilled in the art having the benefit of this disclosure, the grapple would have a corresponding number of control slots, and the bowl would have a corresponding number of slots machined through the threads, as previously described herein.

Figure 22:
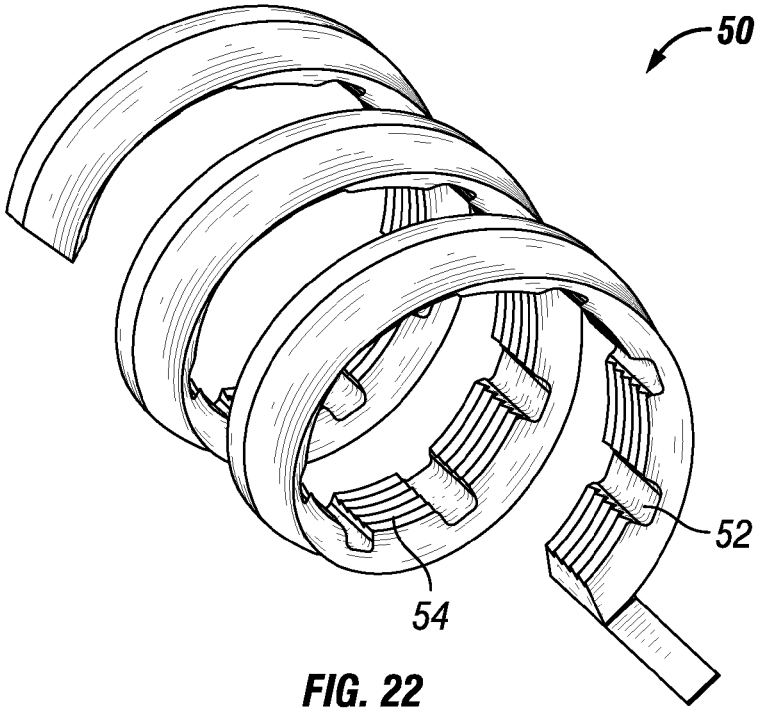
FIGS. 22 and 23 illustrate a spiral grapple according to an exemplary embodiment of the present invention.
Figure 23:
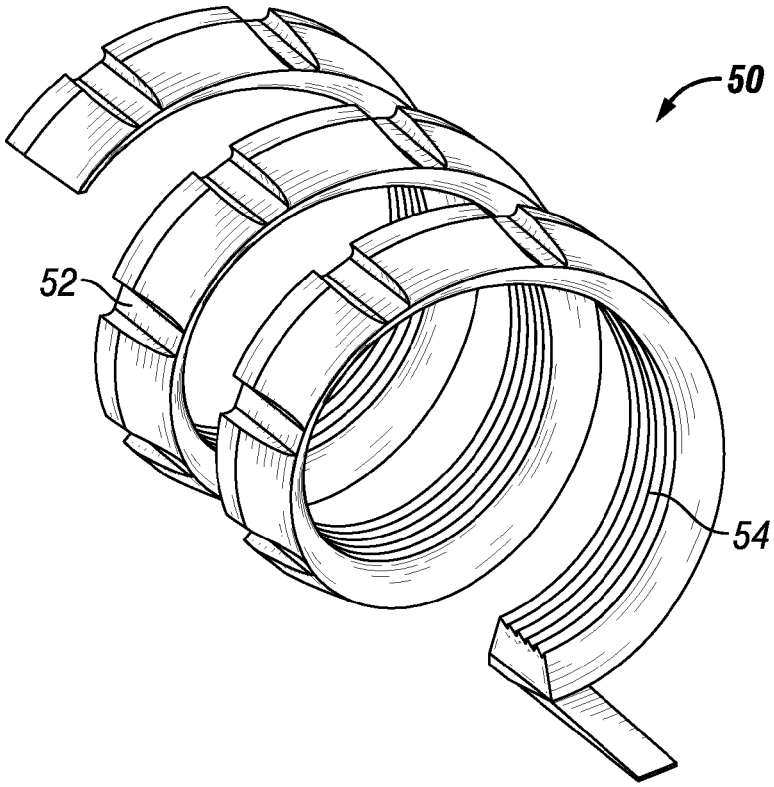
Figure 24:
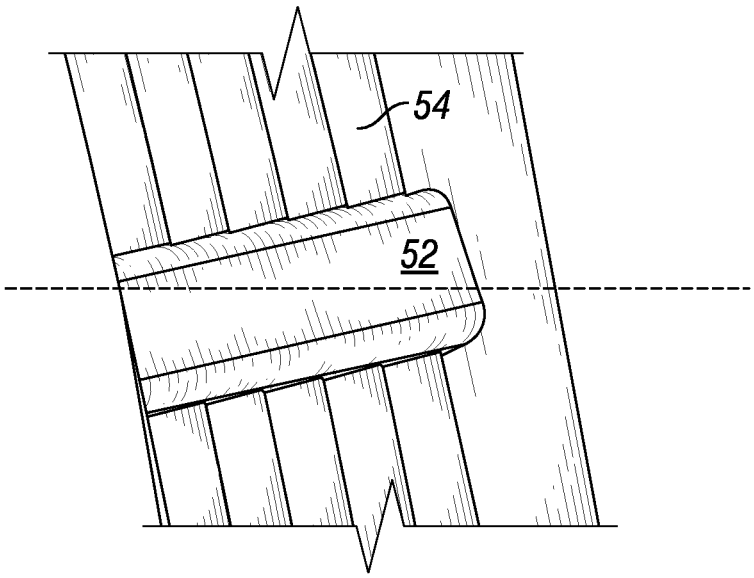
FIG. 24 illustrates a groove for use with the spiral grapple of FIGS. 22 and 23.
Figure 27:
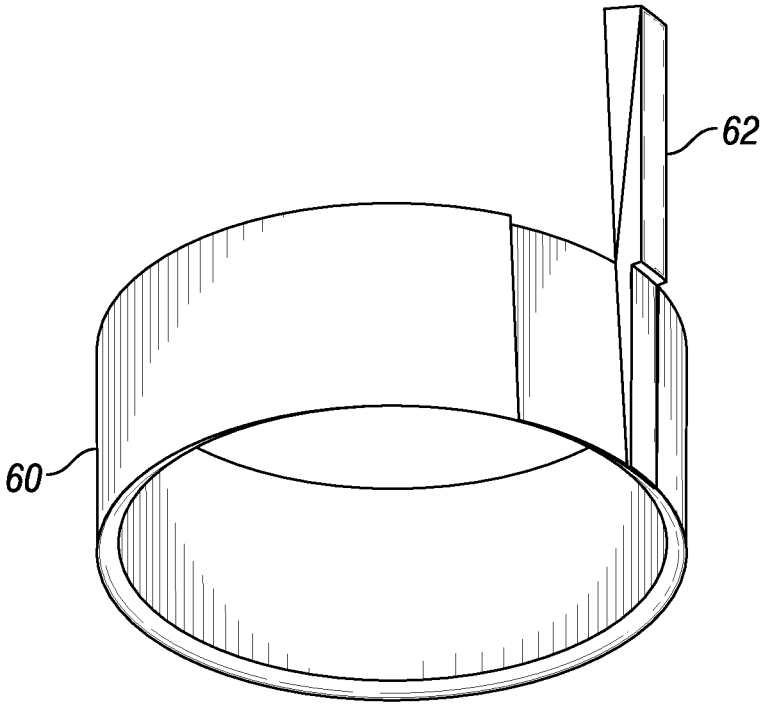
FIG. 27 illustrates a control having an offset finger for use with a spiral grapple according to an exemplary embodiment of the present invention.

An alternative embodiment of the present invention is illustrated in FIG. 22. Spiral grapple 50 may be used in the overshot to engage material that is larger than what a basket grapple is capable of engaging. As a result of designing the larger range overshot of the present invention, spiral grapple 50 has been designed with an excessively thick cross-section. When attempting to engage on the maximum size fish, the grapple 50 must expand significantly. This could potentially cause the stress on the ID to increase and cracks to appear. To reduce the cracks, grooves 52 are added to the ID or OD (FIG. 23) of grapple 50. Those ordinarily skilled in the art having the benefit of this disclosure realize the dimensions of grooves 52 and number can be varied as desired. As illustrated in FIGS. 22 and 23, grooves 52 may be cut straight down grapple 50 parallel to its axis. In the alternative, however, grooves 52 may be cut at various angles as illustrated in FIG. 24. FIG. 27 illustrates an exemplary spiral grapple control 60 having an offset finger 62 as would be understood by one ordinarily skilled in this art having the benefit of this disclosure.

Figure 25:
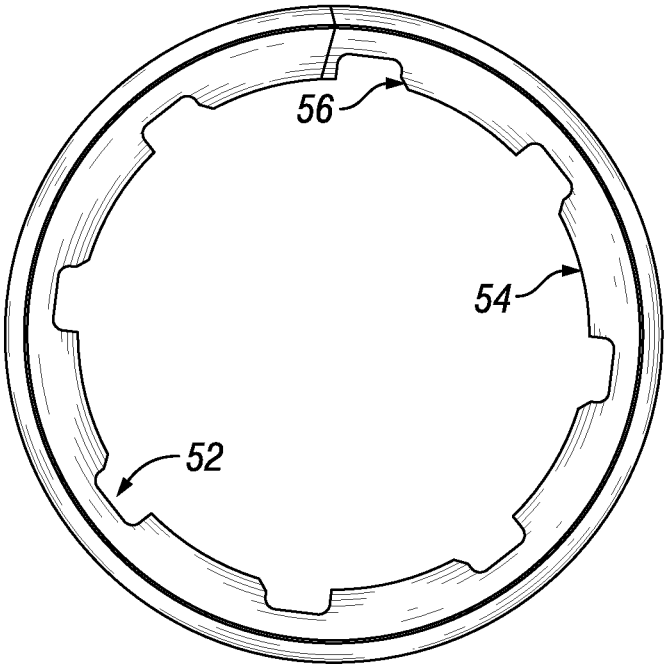
FIG. 25 illustrates a bottom-side view of a spiral grapple according to an exemplary embodiment of the present invention.
Figure 26:
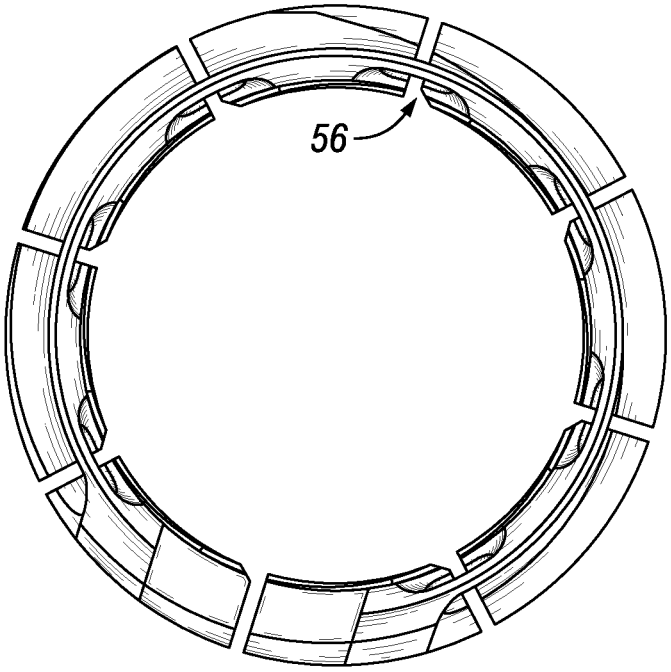
FIG. 26 illustrates a bottom-side view of a basket grapple according to an exemplary embodiment of the present invention.

FIG. 25 illustrates a bottom side view of spiral grapple 50. When a spiral grapple is rotated over a fish, there is a possibility that the edge of grooves 52 will bit into the fish. In order to alleviate this problem, this embodiment of the present invention provides a chamfered edge 56 on wicker 54 so that the leading edge of wicker 54 will not be sharp as to bite into the fish. This feature may be added to the opposite side as well, should rotating be done in the opposite direction. In addition, the chamfered edge could be utilized in basket grapples made in accordance with the present invention as illustrated in FIG. 26. Here, chamfered edge 56 is shown on the leading edge of wickers as previously discussed in relation to the spiral grapple.

An exemplary embodiment of the present invention provides an overshot comprising a bowl having a bore therethrough; a grapple placed inside the bore of the bowl, the grapple comprising a tension ring having a helix diameter and a control finger slot, wherein portions of the helix diameter adjacent both sides of the control finger slot are larger in relation to remaining portions of the helix diameter; and a plurality of segments extending from the tension ring, the overshot further including a control located within the control finger slot. In the alternative embodiment, the control comprises at least a partial ring member and a finger extending from the ring member, wherein an outer surface of the finger is offset in relation to an outer surface of the ring member. In yet another embodiment, the ring member further comprises teeth extending from the ring member in a direction opposite the finger. In yet another embodiment, the remaining portions of the helix diameter of the grapple have been reduced to a minimum helix diameter.

In another embodiment, the grapple further comprises a composite helix member coupled to the tension ring adjacent both sides of the control finger slot, thereby resulting in the larger helix diameter. In yet another exemplary embodiment, the grapple further comprises a plurality of expansion blades along an inner diameter of the tension ring. In another embodiment, the grapple further comprises a groove between adjacent expansion blades. In yet another embodiment, the bowl comprises threads having a groove extending along an entire length of the bowl threads. In another embodiment, the plurality of segments comprises a first and second edge extending along an axis of the grapple, at least one of the first or second edges comprising a chamfered edge.

An exemplary method of the present invention provides a method of using an overshot, the method comprising the steps of (a) providing a bowl having a bore therethough; (b) providing a grapple placed inside the bore of the bowl, the grapple comprising a tension ring having a helix diameter and a control finger slot, wherein portions of the helix diameter adjacent both sides of the control finger slot are larger in relation to remaining portions of the helix diameter; and a plurality of segments extending from the tension ring; (c) providing a control located within the control finger slot; and (d) using the overshot in a downhole operation. In the alternative, the control comprises a ring member and a finger extending from the ring member, step (c) further comprises the step of offsetting an outer surface of the finger in relation to an outer surface of the ring member. In yet another exemplary methodology, step (c) further comprises the step of providing teeth that extend from the ring member in a direction opposite the finger. In another methodology, step (b) further comprises the step of reducing the helix diameter to a minimum helix diameter. In yet another methodology, step (b) further comprises the step of coupling a composite helix member to the tension ring adjacent both sides of the control finger slot, thereby resulting in the larger helix diameter.

In yet another methodology, the method further comprises the step of providing a plurality of expansion blades along an inner diameter of the tension ring of the grapple. In another methodology, the method further comprises the step of providing a groove between adjacent expansion blades. In yet another methodology, the bowl comprises threads, and step (a) further comprises the step of providing a groove extending along an entire length of the threads. In another methodology, the downhole operation in step (d) is a fishing operation.

Another exemplary embodiment of the present invention provides a grapple comprising a tension ring having a helix diameter and a control finger slot, wherein portions of the helix diameter adjacent both sides of the control finger slot are larger in relation to remaining portions of the helix diameter; and a plurality of segments extending from the tension ring. In another embodiment, the remaining portions of the helix diameter have been reduced to a minimum helix diameter. In yet another embodiment, a composite helix member is coupled to the tension ring adjacent both sides of the control finger slot, thereby resulting in the larger helix diameter. In another embodiment, the grapple further comprises a plurality of expansion blades along an inner diameter of the tension ring. In yet another embodiment, the grapple further comprises a groove between adjacent expansion blades. In another embodiment, the plurality of segments comprises a first and second edge extending along an axis of the grapple, at least one of the first or second edges comprising a chamfered edge.

An exemplary methodology of the present invention provides a method of using a grapple, the method comprising the steps of (a) providing a tension ring having a helix diameter and a control finger slot, wherein portions of the helix diameter adjacent both sides of the control finger slot are larger in relation to remaining portions of the helix diameter; (b) providing a plurality of segments extending from the tension ring; and (c) utilizing the grapple in a downhole operation. In the alternative, the methodology further comprises the step of reducing the remaining portions of the helix diameter to a minimum helix diameter. In yet another exemplary methodology, the method further comprises the step of coupling a composite helix member to the tension ring adjacent both sides of the control finger slot, thereby resulting in the larger helix diameter. In another methodology, the method further comprises the step of providing a plurality of expansion blades along an inner diameter of the tension ring. In another methodology, the method further comprises the step of providing a groove between adjacent expansion blades. In yet another exemplary methodology, the downhole operation in step (c) is a fishing operation.

Yet another exemplary embodiment of the present invention provides a control comprising at least a partial ring member; and at least one finger extending from the ring member, wherein an outer surface of the at least one finger is offset in relation to an outer surface of the ring member. In another embodiment, the ring member further comprises teeth extending from the ring member in a direction opposite the at least one finger.

An exemplary methodology of the present invention provides a method of using a control, the method comprising the steps of (a) providing at least a partial ring member; and (b) providing at least one finger extending from the ring member, wherein an outer surface of the at least one finger is offset in relation to an outer surface of the ring member; and (c) utilizing the control with a grapple. In the alternative, the method further comprises the step of providing teeth which extend from the ring member in a direction opposite the at least one finger.

An exemplary embodiment of the present invention provides an overshot comprising a bowl having a bore therethrough; a spiral grapple placed inside the bore of the bowl, the spiral grapple comprising a spiral body having an inner surface and an outer surface; at least one wicker along the inner surface; and at least one groove along the spiral body, the groove extending along an axis of the grapple; and a control located within the control finger slot. In the alternative, the at least one groove is on the inner surface of the spiral body. In yet another embodiment, the at least one groove is on the outer surface of the spiral body. In another embodiment, the wicker comprises a first and second edge running along the axis of the grapple, the wicker further comprising a chamfered edge on at least one of the first or second edges.

An exemplary methodology of the present invention provides a method of using an overshot, the method comprising the steps of (a) providing a bowl having a bore therethrough; (b) providing a spiral grapple placed inside the bore of the bowl; (c) providing the spiral grapple with a spiral body having an inner surface and an outer surface; (d) providing at least one wicker along the inner surface of the spiral body; (e) providing at least one groove along the spiral body, the groove extending along an axis of the grapple; (f) providing a control located within the control finger slot; and (g) utilizing the overshot in a downhole operation. In another methodology, step (e) further comprises the step of providing the at least one groove on the inner surface of the spiral body. In yet another methodology, step (e) further comprises the step of providing the at least one groove on the outer surface of the spiral body. In another methodology, the wicker comprises a first and second edge running along the axis of the grapple, step (d) further comprises the step of providing a chamfered edge on at least one of the first or second edges.

Another exemplary embodiment of the present invention provides a spiral grapple comprising a spiral body having an inner surface and an outer surface; at least one wicker along the inner surface; and at least one groove along the spiral body, the groove extending along an axis of the grapple. In another embodiment, the groove is on the inner surface of the spiral body. In yet another embodiment, the groove is on the outer surface of the spiral body. In yet another embodiment, the wicker comprises a first and second edge running along the axis of the grapple, the wicker further comprising a chamfered edge on at least one of the first or second edges.

Another exemplary methodology of the present invention provides a method of using a spiral grapple, the method comprising the steps of (a) providing a spiral body having an inner surface and an outer surface; (b) providing at least one wicker along the inner surface; (c) providing at least one groove along the spiral body, the groove extending along an axis of the grapple; and (d) utilizing the grapple in a downhole operation. In another methodology, step (c) further comprises the step of providing the groove on the inner surface of the spiral body. In yet another methodology, step (c) further comprises the step of providing the groove on the outer surface of the spiral body. In another methodology, the wicker comprises a first and second edge running along the axis of the grapple, step (b) further comprising the step of providing the wicker with a chamfered edge on at least one of the first or second edges. In yet another methodology, the downhole operation in step (d) is a fishing operation.

Although various embodiments have been shown and described, the invention is not limited to such embodiments and will be understood to include all modifications and variations as would be apparent to one skilled in the art. For example, those ordinarily skilled in the art having the benefit of this disclosure realize the embodiments of the present invention may be combined or utilized separately. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. An overshot comprising:

a bowl having a bore therethrough and an inner surface comprising threads having a slot extending along an entire length of the bowl threads configured to house a control finger;

a grapple placed inside the bore of the bowl, the grapple comprising:

a tension ring having a helix diameter and a control finger slot, wherein portions of the helix diameter adjacent both sides of the control finger slot are larger in relation to remaining portions of the helix diameter; and a plurality of segments extending from the tension ring; and a control located within the control finger slot, wherein the control comprises a ring member and the control finger extending from the ring member, wherein an outer surface of the control finger is radially offset in relation to an outer surface of the ring member.

2. The overshot of claim 1, wherein the ring member further comprises teeth extending from the ring member in a direction opposite the finger.

3. The overshot of claim 1, wherein the remaining portions of the helix diameter of the grapple have been reduced to a minimum helix diameter.

4. The overshot of claim 1, wherein the grapple further comprises a composite helix member coupled to the tension ring adjacent both sides of the control finger slot.

5. The overshot of claim 1, wherein the grapple further comprises a plurality of expansion blades along an inner diameter of the tension ring.

6. The overshot of claim 5, wherein the grapple further comprises a groove between adjacent expansion blades.

7. The overshot of claim 1, wherein the plurality of segments comprises a first and second edge extending along an axis of the grapple, at least one of the first or second edges comprising a chamfered edge.

8. The overshot of claim 1, wherein the plurality of segments are configured to expand to engage a fish and wherein the expansion of the plurality of segments begins before the fish contacts the segments.

9. A method of using an overshot, the method comprising the steps of:

(a) providing a bowl having a bore therethough and an inner surface comprising threads having a slot extending along an entire length of the bowl threads configured to house a control finger;

(b) providing a grapple placed inside the bore of the bowl, the grapple comprising:

a tension ring having a helix diameter and a control finger slot, wherein portions of the helix diameter adjacent both sides of the control finger slot are larger in relation to remaining portions of the helix diameter; and a plurality of segments extending from the tension ring;

(c) providing a control located within the control finger slot, wherein the control comprises a ring member and the control finger extending from the ring member, wherein an outer surface of the control finger is radially offset in relation to an outer surface of the ring member; and (d) using the overshot in a downhole operation.

10. A method as defined in claim 9, wherein step (c) further comprises the step of providing teeth that extend from the ring member in a direction opposite the finger.

11. The method of claim 9, wherein step (b) further comprises the step of reducing the helix diameter to a minimum helix diameter.

12. The method of claim 9, wherein step (b) further comprises the step of coupling a composite helix member to the tension ring adjacent both sides of the control finger slot.

13. The method of claim 9, further comprising the step of providing a plurality of expansion blades along an inner diameter of the tension ring of the grapple.

14. The method of claim 13, further comprising the step of providing a groove between adjacent expansion blades.

15. The method of claim 9, wherein the downhole operation in step (d) is a fishing operation.

16. The method of using an overshot of claim 9, wherein the step of providing a grapple in step (b) further comprises having the plurality of segments extending from the tension ring configured to expand to engage a fish and wherein the expansion of the plurality of segments begins before the fish contacts the segments.

17. A grapple comprising:

a tension ring having a helix diameter and a control finger slot, wherein portions of the helix diameter adjacent both sides of the control finger slot are larger in relation to remaining portions of the helix diameter;

a composite helix member coupled to the tension ring adjacent both sides of the control finger slot, thereby resulting in the larger helix diameter and a plurality of segments extending from the tension ring, the plurality of segments configured to expand to engage a fish wherein expansion of the plurality of segments begins before the fish contacts the segments.

18. The grapple of claim 17, wherein the remaining portions of the helix diameter have been reduced to a minimum helix diameter.

19. The grapple of claim 17, further comprising a plurality of expansion blades along an inner diameter of the tension ring.

20. The grapple of claim 19, further comprising a groove between adjacent expansion blades.

21. The grapple of claim 17, wherein the plurality of segments comprises a first and second edge extending along an axis of the grapple, at least one of the first or second edges comprising a chamfered edge.

22. An overshot comprising:

a bowl having a bore therethrough and an inner surface comprising threads having a slot extending along an entire length of the bowl threads configured to house a control finger;

a spiral grapple placed inside the bore of the bowl, the spiral grapple comprising:

a spiral body having an inner surface and an outer surface;

at least one wicker along the inner surface; and at least one groove along the spiral body, the groove extending along an axis of the grapple; and a control to engage the grapple, wherein the control comprises a ring member and at least one finger extending from the ring member such that an outer surface of the at least one finger is radially offset in relation to an outer surface of the ring member.

23. The overshot of claim 22, wherein the at least one groove is on the inner surface of the spiral body.

24. The overshot of claim 22, wherein the at least one groove is on the outer surface of the spiral body.

25. The overshot of claim 22, wherein the wicker comprises a first and second edge running along the axis of the grapple, the wicker further comprising a chamfered edge on at least one of the first or second edges.

26. A method of using an overshot, the method comprising the steps of:

(a) providing a bowl having a bore therethrough and an inner surface comprising threads having a slot extending along an entire length of the bowl threads configured to house a control finger;

(b) providing a spiral grapple placed inside the bore of the bowl;

(c) providing the spiral grapple with a spiral body having an inner surface and an outer surface;

(d) providing at least one wicker along the inner surface of the spiral body;

(e) providing at least one groove along the spiral body, the groove extending along an axis of the grapple;

(f) providing a control located within the control finger slot; wherein the control comprises a ring member and at least one finger extending from the ring member such that the outer surface of the at least one finger is radially offset in relation to an outer surface of the ring member; and (g) utilizing the overshot in a downhole operation.

27. The method of claim 26, wherein step (e) further comprises the step of providing the at least one groove on the inner surface of the spiral body.

28. The method of claim 26, wherein step (e) further comprises the step of providing the at least one groove on the outer surface of the spiral body.

29. The method of claim 26, wherein the wicker comprises a first and second edge running along the axis of the grapple, step (d) further comprising the step of providing a chamfered edge on at least one of the first or second edges.

* * * * *